US008418945B2

(12) United States Patent
Kjaerran et al.

(10) Patent No.: US 8,418,945 B2
(45) Date of Patent: Apr. 16, 2013

(54) CAVITY RING FOR A VERTICAL SHAFT IMPACT CRUSHER

(75) Inventors: Knut Kjaerran, Svedala (SE); Rowan Dallimore, Bath and North East Somerset (GB)

(73) Assignee: Sandvik Intellectual Property AB, Sandviken (SE)

( * ) Notice: Subject to any disclaimer, the term of this patent is extended or adjusted under 35 U.S.C. 154(b) by 215 days.

(21) Appl. No.: 12/781,438

(22) Filed: May 17, 2010

(65) Prior Publication Data

US 2011/0062265 A1 Mar. 17, 2011

(30) Foreign Application Priority Data

May 18, 2009 (SE) ..... 0900665

(51) Int. Cl.
*B02C 19/00* (2006.01)

(52) U.S. Cl.
USPC ..... 241/275

(58) Field of Classification Search ..... 241/275
See application file for complete search history.

(56) References Cited

U.S. PATENT DOCUMENTS 4,065,063 A 12/1977 Johnson
4,896,838 A 1/1990 Vendelin et al.

FOREIGN PATENT DOCUMENTS

EP 0 261 913 3/1988
WO 2004/020103 3/2004

OTHER PUBLICATIONS

Search Report dated Aug. 16, 2010 for International Application No. PCT/SE2010/050519 filed May 11, 2010.

*Primary Examiner* — Mark Rosenbaum
(74) *Attorney, Agent, or Firm* — Morgan, Lewis & Bockius LLP

(57) ABSTRACT

A vertical shaft impact crusher includes a rotor for accelerating a first flow of material to be crushed, a first feed element for feeding the first flow of material to the rotor, a housing including a circumferential impact wall section against which the accelerated first flow of material may be crushed, and a second feed element for feeding a second flow of material towards a distributing wall section of the housing and further into the path of the accelerated first flow of material. A cavity ring separates the impact wall section from the distributing wall section. The cavity ring includes at least two ring segments. Supports are provided for supporting the ring segments. A locking device is provided for pressing the ring segments towards at least one of the supports.

12 Claims, 6 Drawing Sheets

CAVITY RING FOR A VERTICAL SHAFT IMPACT CRUSHER

CROSS-REFERENCE TO PRIOR APPLICATION

This application claims priority to Swedish Application No. 0900665-1 filed May 18, 2009, which is incorporated by reference herein.

TECHNICAL FIELD

The disclosure relates to a vertical shaft impact crusher for crushing material. The crusher includes a rotor for accelerating a first flow of material to be crushed, a first feed element for feeding the first flow of material to the rotor, a housing including a circumferential impact wall section against which the accelerated first flow of material may be crushed, a second feed element for feeding a second flow of material to be crushed towards a distributing wall section of the housing and further into the path of the accelerated first flow of material, and a cavity ring separating the impact wall section from the distributing wall section.

The disclosure also relates to a method of mounting a cavity ring in a vertical shaft impact crusher, to a wear part for a vertical shaft impact crusher, and to a cavity ring.

BACKGROUND ART

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Vertical shaft impact crushers (VSI-crushers) are used in many applications for crushing hard material, like rocks, ore etc. WO 2004/020103 describes a VSI-crusher including a housing and a horizontal rotor located inside the housing. A first material flow is fed to the rotor via an opening in the top thereof. The first material flow is accelerated by the rotor and is ejected towards the wall of the housing. A second material flow is fed outside the rotor, for example, between the rotor and the housing. This second material flow is hit by the first material flow ejected by the rotor. Thus, the first and second material flows are crushed against each other just outside the rotor.

The second material flow is directed into the first material flow via a hillside of material which has been built up against an upper surface of a cavity ring, which separates a distributing wall section from an impact wall section, and one or more collection plates that are located on the upper surface of the cavity ring. The second material flow causes wear on the cavity ring and the collection plates, resulting in frequent need for time consuming and cumbersome maintenance work.

SUMMARY

It is desired to provide a vertical shaft impact crusher which reduces the problems generated by the second material flow causing wear on the cavity ring and the collection plates.

This can be achieved by a vertical shaft impact crusher for crushing material that includes a rotor for accelerating a first flow of material to be crushed, a first feed element for feeding the first flow of material to the rotor, a housing including a circumferential impact wall section against which the accelerated first flow of material may be crushed, a second feed element for feeding a second flow of material to be crushed towards a distributing wall section of the housing and further into the path of the accelerated first flow of material, and a cavity ring separating the impact wall section from the distributing wall section. The cavity ring includes at least two ring segments, at least two supports being provided for supporting the at least two ring segments, and a locking device being provided for pressing at least one of the ring segments towards at least one of the supports.

An advantage of this crusher is that the cavity ring is easy to replace when worn or damaged. This reduces the time lost at maintenance stops. Furthermore, if only a portion of the cavity ring is damaged or worn, only one segment may need to be replaced with a new segment, hence reducing the spare part costs of the crusher.

According to one embodiment, at least one of the supports is adapted to be located below the at least two ring segments, and the locking device is adapted for being located, at least partly, above the at least two ring segments. An advantage of this embodiment is that it is usually easier to access the upper part of the cavity ring, since the hillsides formed on top of the cavity ring contain less material, and are less compact, compared to the bed of retained material located under the cavity ring. Hence, replacing a cavity ring segment is made easier if the locking device can be inactivated without needing to first remove the bed of retained material. Furthermore, the wear load from the material to be crushed is normally larger below the cavity ring, than above it. Hence, locating the locking device, at least partly, above the at least two ring segments decreases the wear on the locking device, and reduces the risk that the locking device is destroyed during operation of the crusher.

According to one embodiment, at least one of the supports includes an extension being adapted for extending from a lower side of at least one of the at least two ring segments to an upper side of the ring segment. An advantage of this embodiment is that by making a locking device cooperate with the extension, a firm force pressing the segment down towards the support can be achieved.

According to one embodiment, the locking device includes at least one wedge being adapted for cooperating with the extension for pressing at least one of the ring segments towards at least one of the supports. One advantage of using a wedge is that a wedge is less sensitive to wear compared to, for example, a screw having a thread. A further advantage is that very simple tools, such as a sledge, can be used for forcing the wedge into position, or for removing the wedge when dismounting the locking device. A sledge is also suitable for providing a pressing force when acting on a wedge.

According to one embodiment, at least one of the at least two ring segments includes at least one extension notch adapted to embrace, at least partly, the extension. An advantage of this embodiment is that the cavity ring will provide a better and tight support for building the hillsides, and that the locking of the segments by the locking device will be more efficient. More particularly, at least one of the extension notches is located at an end of the ring segment. An advantage of this embodiment is that one locking device can be adapted for holding two neighboring segments in place. Furthermore, the at least one extension notch makes it easier to obtain a correct location of the segment on the supports.

According to one embodiment, at least one of the ring segments includes a horizontal plate and an outer support bar attached to the horizontal plate and being adapted for cooperating with at least one of the supports for locking the ring segment in the horizontal direction. An advantage of the outer support bar is that it may both provide strength to the segment and also lock it at the wall of the crusher, thereby reducing the risk that the segment is released and comes into contact with the rotor and/or comes into the path of the accelerated first flow of material. The outer support bar also makes it easier to obtain a correct position of the segments, when an operator is to mount them in the crusher.

According to one embodiment, the cavity ring includes at least four ring segments, and more particularly four to six ring segments. At least four ring segments make the size of each segment comparably small, which makes it easier to mount and dismount the cavity ring. To have more than six segments is usually no further advantage, since each segment becomes comparably small, which might increase the need for further supports to ensure that each segment is properly supported.

According to one embodiment, the locking device includes a handle and a cam being rotatably mounted to an extension. The extension is adapted for extending from a lower side of at least one of the at least two ring segments to an upper side of the ring segment. The cam is adapted for pressing against the upper side of at least one of the ring segments upon a turning of the handle. A handle with a cam can be used in combination with other locking devices, such as wedges, or as an alternative to other locking devices. Also the handle and cam arrangement is robust and requires only simple tools, if any, for locking and unlocking the segments.

Further embodiments can provide an efficient manner of mounting a cavity ring in a vertical shaft impact crusher by a method of mounting a cavity ring in a vertical shaft impact crusher which is of the above referenced type. The method includes the steps of introducing at least two ring segments forming the cavity ring into the crusher, locating one of the ring segments on at least one support, and pressing the ring segment towards the support by a locking device.

An advantage of this method is that mounting the cavity ring, or just one segment, if replacing just one segment is sufficient, becomes a quick task, that can be made in short time, and with little physical burden to the operator performing the mounting.

Further embodiments can provide a wear part for a cavity ring of a vertical shaft impact crusher, which wear part is easier to change than the wear parts of the prior art by a vertical shaft impact crusher wear part for a vertical shaft impact crusher of the above referenced type. The wear part can be a ring segment adapted for forming a part of the cavity ring including at least two ring segments. The ring segment is adapted for being supported by at least one support, and is adapted for being pressed towards the at least one support by a locking device. An advantage of this wear part is that mounting, dismounting, and replacement become efficient and easy.

It is to be understood that both the foregoing general description and the following detailed description are exemplary and explanatory and are intended to provide further explanation of the invention as claimed.

BRIEF DESCRIPTION OF THE DRAWINGS

A particular embodiment of the invention will be described in more detail below, reference being made to the appended drawings, on which.

DETAILED DESCRIPTION OF PREFERRED EMBODIMENTS

Figure 1:
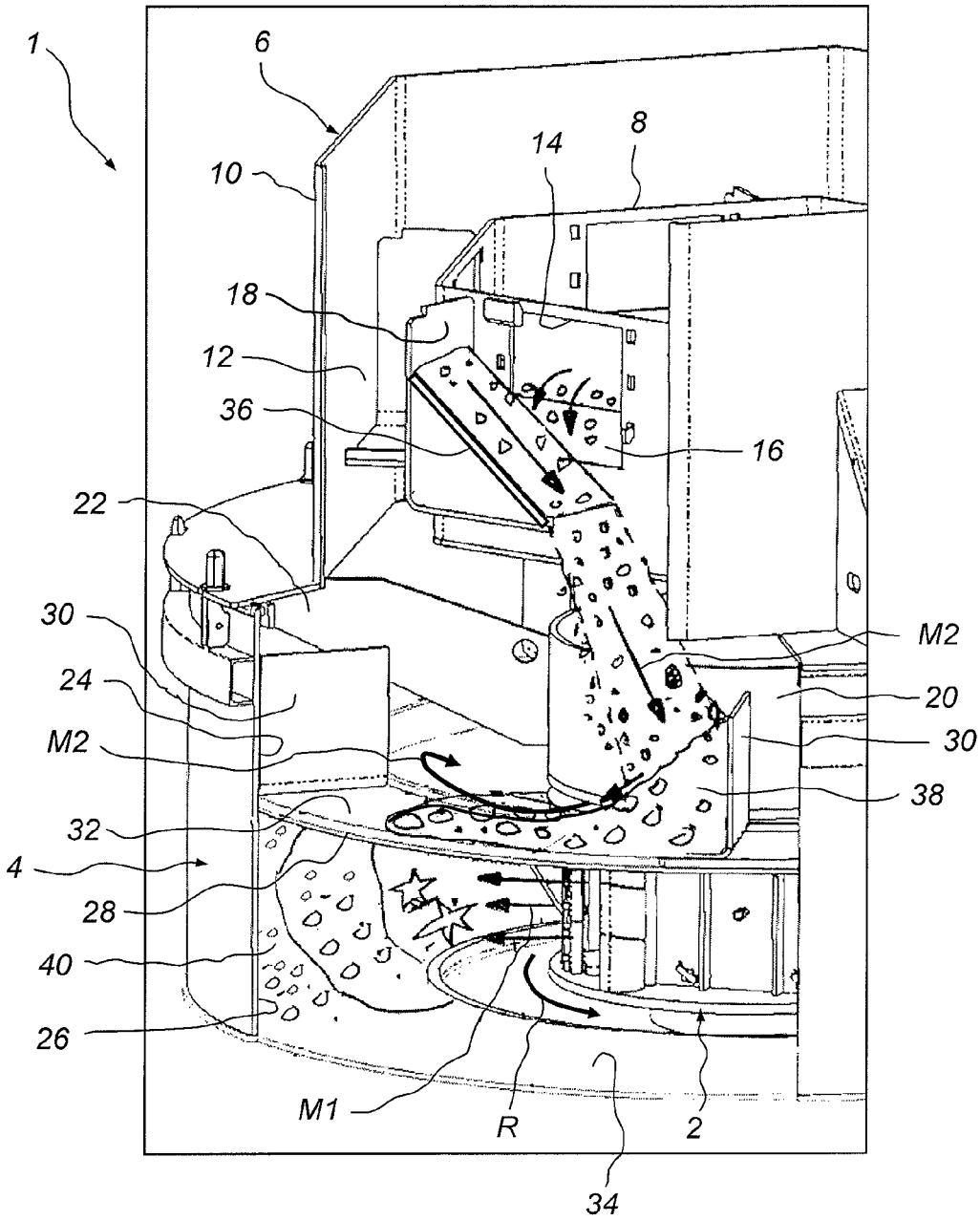
FIG. 1 is a three dimensional view, partly in section, and illustrates the pathway of first and second flows of material in an exemplary vertical shaft impact crusher.

In FIG. 1, a vertical shaft impact crusher 1 is shown, partly in cross-section. A rotor 2 is located inside a housing 4 of the crusher 1. A feed hopper 6 is located at the top of the crusher 1. The feed hopper 6 has a hexagonal inner hopper 8, and a hexagonal outer hopper 10 surrounding the inner hopper 8. A roof, not shown in FIG. 1, seals a space 12 formed between the inner hopper 8 and the outer hopper 10 from above. The inner hopper 8 is provided with six outlets 14, each such outlet 14 being located at a side of the hexagonal inner hopper 8. Each outlet 14 is provided with a movable hatch 16. The movable hatch 16 may be placed in different positions on the inner hopper 8 to obtain a desired open area of the respective outlet 14. An "L"-shaped direction arm 18 is fixed between the inner hopper 8 and the outer hopper 10 adjacent to each of the outlets 14, in the space 12. Below the inner hopper 8 a central feeding cylinder 20 is placed. The feeding cylinder 20 is fixed to the inside of the housing 4 with the aid of three beams, of which only the beam 22 is shown in FIG. 1.

A circumferential distributing wall section 24 is located at the same level as the feeding cylinder 20. Below the distributing wall section 24 and on the same level as the rotor 2 a circumferential impact wall section 26 is located. A cavity ring 28 separates the distributing wall section 24 from the impact wall section 26. A number of vertical collection plates 30, which extend in a radial manner with respect to the rotor 2, are fixed to the upper surface 32 of the cavity ring 28. A bed retention ring 34 is located at the bottom of the crusher 1.

The operation of the crusher 1 will now be described in more detail with reference to FIG. 1. Material to be crushed is fed to the inner hopper 8. A first flow of material M1 will reach the rotor 2 via an inlet at the bottom of the inner hopper 8 and the feeding cylinder 20, and a second flow of material M2 will be forwarded outside of the rotor 2 via the outlets 14. By varying the position of the respective hatches 16 covering the outlets 14 the amount of the second flow of material M2 can be adjusted. An arrow R indicates the direction of rotation of the rotor 2.

The direction arm 18 is provided with a slide plate 36. The slide plate 36 is inclined in a direction being substantially tangential in relation to the rotor 2. The second flow of material M2 leaving the outlet 14 will slide on the slide plate 36 in a direction being substantially tangential in relation to the rotor 2, the second flow of material M2 thus obtaining a movement in a direction having a substantially tangential component in relation to the rotor 2. The second flow of material M2 will thus in a first step be directed towards the distributing wall section 24. At the location of the distributing wall section 24 where the second flow of material M2 would impinge the wall section 24 the collection plate 30 is located.

During the first minutes of crusher operation the second flow of material M2 will build a hillside 38 of material against the collection plate 30 and the upper surface 32 of the cavity ring 28. After the hillside 38 has been established the rest of the second flow of material M2 will, in a second step, slide on the second hillside 38. The second flow of material M2 will thus, in this second step, obtain a movement having a substantially tangential component in relation to the rotor 2. The second flow of material M2 will then pass on down into a position adjacent to the impact wall section 26. Adjacent to the impact wall section 26 the second flow of material M2, having a movement with a substantially tangential component, will be hit by the first flow of material M1 ejected by the rotor 2, which will result in efficient crushing of both material flows M1 and M2. A bed of retained material 40, against which the two flows of material M1 and M2 may impact, is built up on the bed retention ring 34 during operating of the crusher 1, and protects the impact wall section 26 from wear.

Figure 2:
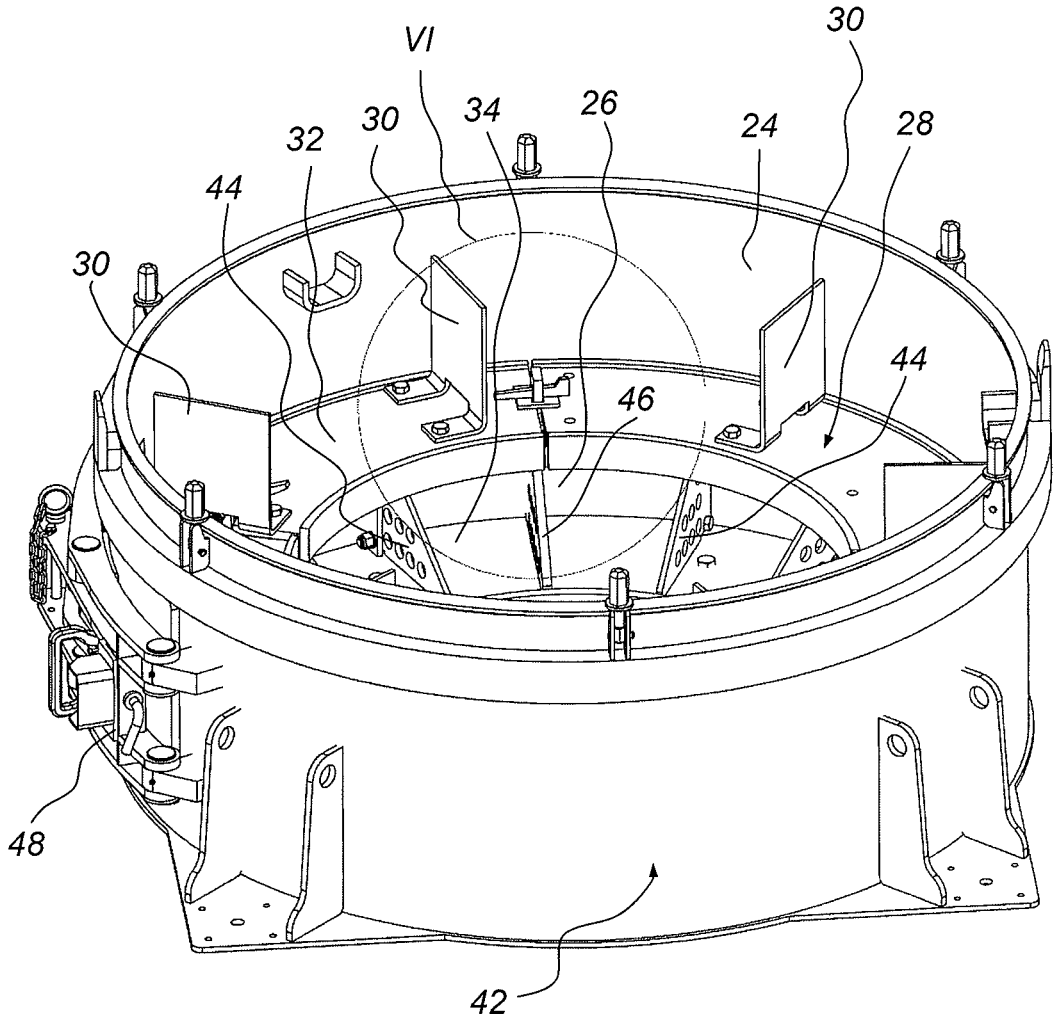
FIG. 2 is a three dimensional view, and illustrates the lower portion of the crusher of FIG. 1.

FIG. 2 illustrates the lower portion 42 of the housing 4, illustrated in FIG. 1, of the crusher 1. The cavity ring 28 separating the distributing wall section 24 from the impact wall section 26 is divided into a number of segments, as will be described in more detail hereinafter. The vertical collection plates 30 are fixed to the upper surface 32 of the cavity ring 28.

The lower portion 42 is provided with a number of supports in the form of gussets, including first type of gussets 44 and second type of gussets 46. The gussets 44, 46 are fixed to the impact wall section 26 and support, at their lower ends, the bed retention ring 34. Both types of gussets 44, 46 support, at their upper ends, the segments of the cavity ring 28. The second type of gussets 46 assists in fixing, as will be described in more detail hereinafter, the segments of the cavity ring 28, in addition to supporting them.

An inspection door 48 is provided for allowing access to the interior of the lower portion 42 during maintenance stops.

Figure 3:
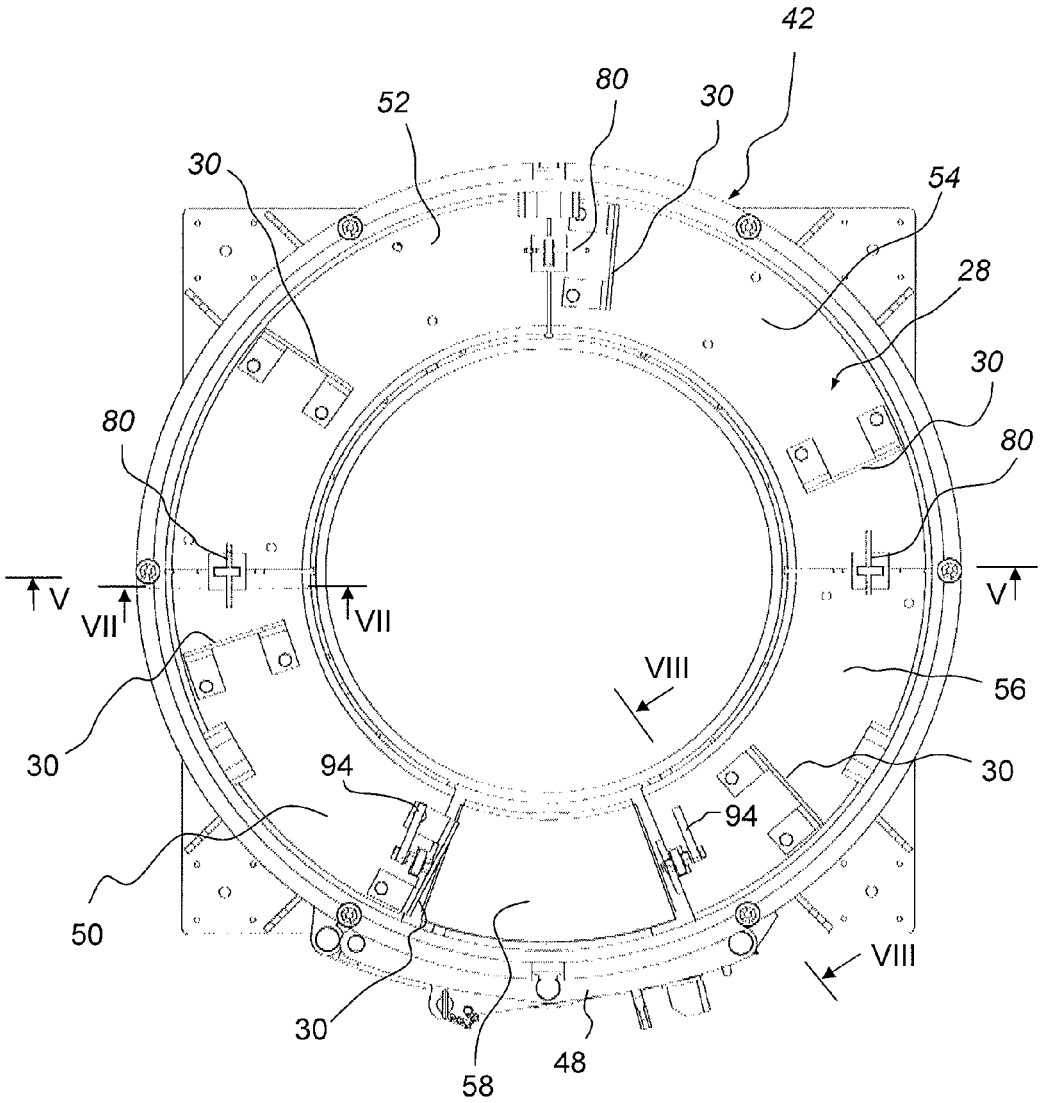
FIG. 3 is a top view, and illustrates the lower portion of the crusher of FIG. 1.

FIG. 3 illustrates the lower portion 42 of the crusher housing 4 as seen from the top thereof. The cavity ring 28 is divided into five cavity ring segments. Of these segments a first segment 50, a second segment 52, a third segment 54, and a fourth segment 56 are of essentially the same type. A fifth segment 58 is located between the first segment 50 and the fourth segment 56 and is bolted directly to the inspection door 48, and will follow the inspection door 48 outwards, when the inspection door is opened.

The second segment 52 and the third segment 54 each extend along about ¼ of the inner periphery of the circular lower portion 42. The first segment 50 and the fourth segment 56 each extend along about ⅕ of the inner periphery of the circular lower portion 42, while the rest of the periphery is covered by the fifth segment 58.

Figure 4:
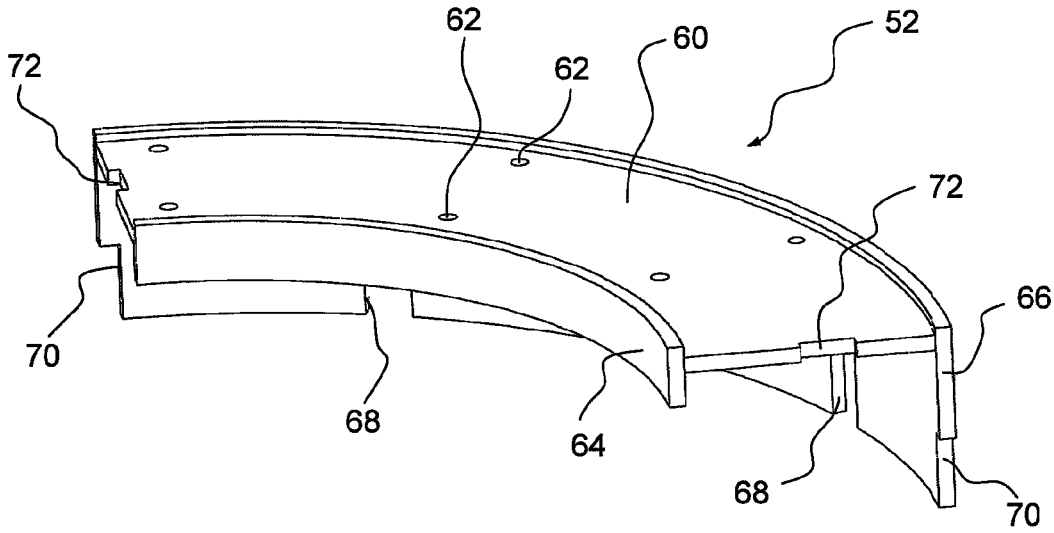
FIG. 4 is a three-dimensional view, and illustrates an exemplary cavity ring segment.

FIG. 4 illustrates the second cavity ring segment 52 in more detail. The first, third and fourth ring segments 50, 54, 56 have a similar design. The ring segment is 52 is provided with a horizontal plate 60 which forms the basis of forming hillsides 38 as described hereinbefore with reference to FIG. 1. The horizontal plate 60 is provided with a number of mounting holes 62 for mounting the collection plates 30. As best illustrated in FIG. 3, the collection plates 30 are mounted in different positions on the segments 50, 52, 54, 56 to match the respective outlets 14 of the inner hopper 8, illustrated in FIG. 1.

Returning to FIG. 4, the ring segment 52 is also provided with an inner support bar 64 and an outer support bar 66. The support bars 64, 66 provide the horizontal plate 60 with sufficient stiffness. Additionally, the inner support bar 64 provides the horizontal plate 60 with protection against objects, such as stones, flying around in the crushing chamber during the crushing process. The outer support bar 66 is provided with three intermediate notches 68, of which the central one is hidden in FIG. 4, making it possible for the outer support bar 66 to embrace gussets of the first type of gussets 44. Furthermore, the outer support bar 66 is provided with, at its respective horizontal ends, end notches 70 making it possible for the outer support bar 66 to embrace gussets of the second type of gusset 46. Finally, the support plate 60 is provided with extension notches 72 at its respective horizontal ends to embrace extensions of the gussets of the second type of gussets 46, in a manner which will be described in more detail hereinafter.

Figure 5:
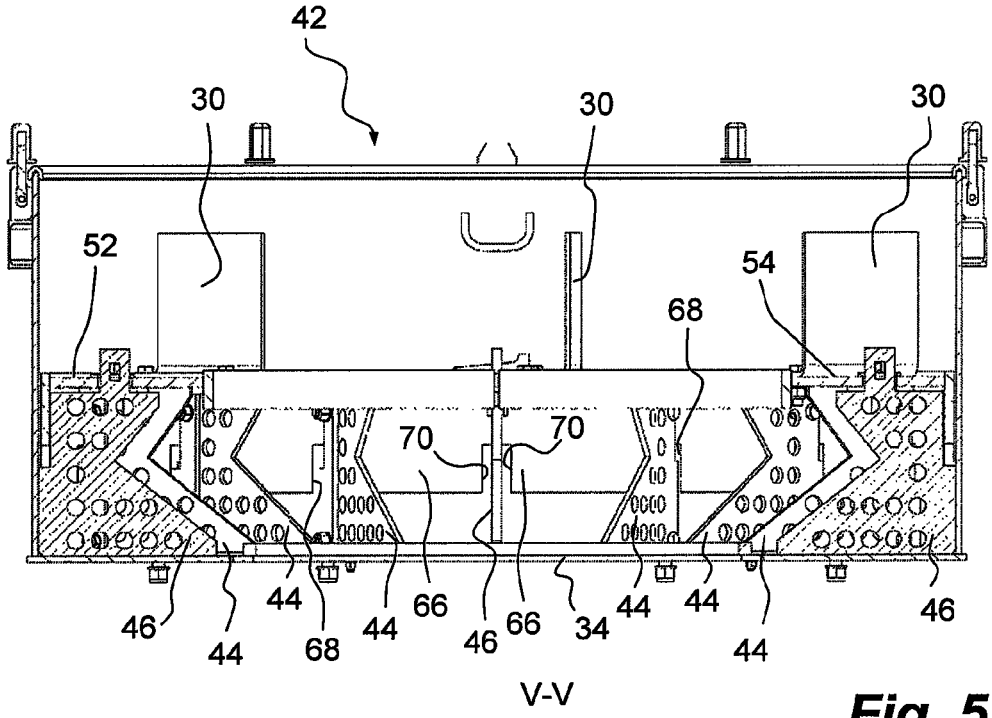
FIG. 5 is a cross-sectional view, and illustrates the lower portion of the crusher of FIG. 1, as seen in the direction of the arrows V-V of FIG. 3.

FIG. 5 illustrates the lower portion 42 of the crusher housing, as seen in a cross-sectional view. The second type of gussets 46 are located at the connections between two cavity ring segments, such as between the first and second ring segments 50, 52, between the second and third ring segments 52, 54, and between the third and fourth ring segments 54, 56. The end notches 70 of the respective ring segments, of which only the ring segments 52, 54 are shown in FIG. 5, make it possible for them to embrace the gusset 46. Furthermore, the intermediate notches 68 make it possible for the respective ring segment 52, 54 to embrace each of three gussets 44 of the first type supporting the lower side of the respective segment 52, 54 and being located between the gussets 46 of the second type.

Figure 6:
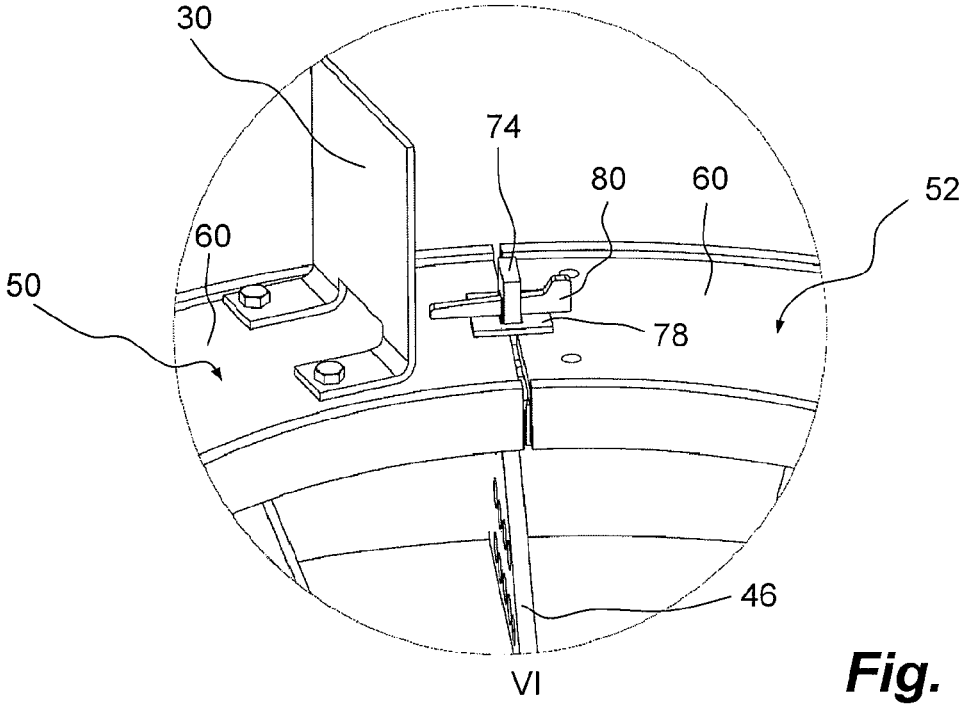
FIG. 6 is an enlarged three dimensional view of the area VI of FIG. 2, and illustrates an exemplary device holding cavity ring segments in place.
Figure 7:
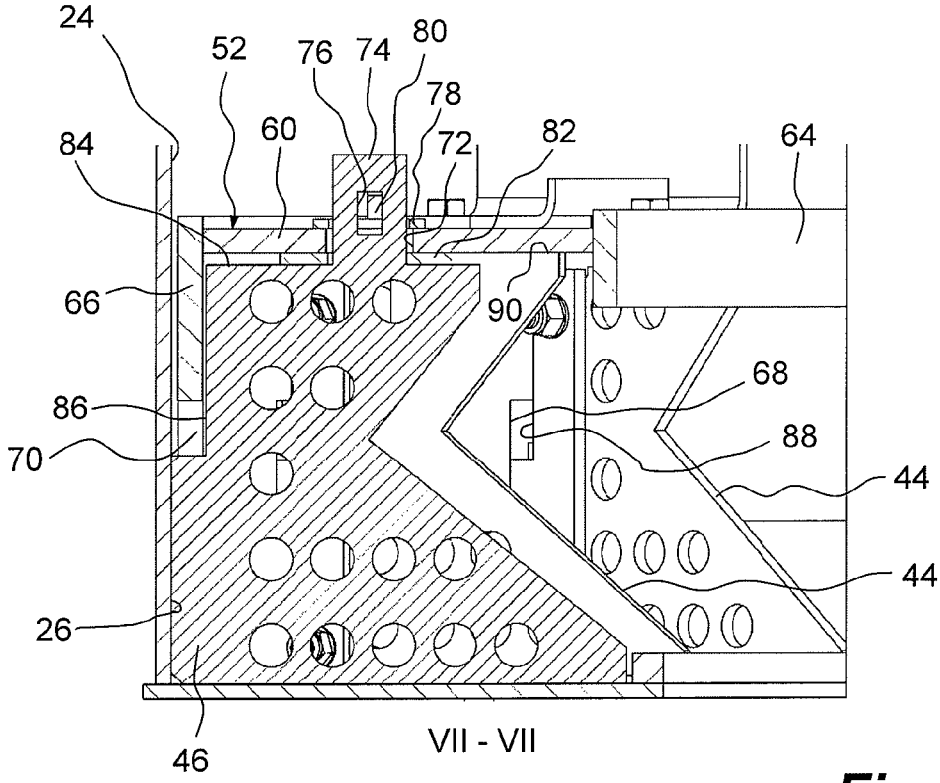
FIG. 7 is an enlarged cross-sectional view, and illustrates the exemplary device holding cavity ring segments in place, as seen in the direction of the arrows VII-VII of FIG. 3.

FIGS. 6 and 7 illustrate in more detail the manner in which the gusset 46 fixes the first and second segments 50, 52 to the lower portion 42.

As is illustrated in FIGS. 6 and 7, the second type of gusset 46 is provided with an extension 74 having the form of an "ear". The extension 74 extends from the lower side of the segments 50, 52 to the upper side of the segments 50, 52. The extension notches 72, which have been illustrated hereinbefore with reference to FIG. 4, embrace the extension 74. A wedge opening 76, which is best illustrated in FIG. 7, is provided in the extension 74 at the upper side of the segments 50, 52. An upper side washer 78 has, as is best shown in FIG. 6, been put around the extension 74, and is in contact with the upper surfaces of the respective horizontal plates 60 of the segments 50, 52. A locking device in the form of a wedge 80, which may, for example, be made of a metal or a polymeric material, such as polytetrafluoroethylene (PTFE), has been forced, in a horizontal direction, through the wedge opening 76 between an upper end of the wedge opening 76 and the upper side washer 78. The wedge 80, being in contact with the upper end of the wedge opening 76 and with the upper side washer 78 exerts a downwardly directed force on the washer 78, and, hence, on the horizontal plates 60 of respective segments 50, 52.

As is best illustrated in FIG. 7, a lower side washer 82 has been put around the extension 74, before locating the segments 50, 52 thereon. The lower side washer 82 rest on a support surface 84 of the gusset 46, being of the second type. Particularly, the lower side washer 82 is provided with extensions being adapted for extending downwards from the upper portion of the washer 82 on both sides of the gusset 46, such that the lower side washer 82 "rides" on the gusset 46. The lower side washer 82 provides an extended horizontal surface for supporting the segments 50, 52, making it easier to find the correct position of the segments 50, 52 when mounting them. The wedge 80 exerts, via the upper side washer 78, a force on the segments 50, 52 pressing them downwards against the gusset 46, via the lower side washer 82, and keeps the segments 50, 52 in place.

Furthermore, the gusset 46 is provided, at its upper peripheral end, with a peripheral notch 86, as illustrated in FIG. 7. The peripheral notch 86 of the gusset 46 matches with the outer support bar 66 of the segment 52. Thus, the support bar 66 can be located between the impact wall section 26 and the gusset 46, thereby keeping the segment 52 fixed in a horizontal direction. The end notch 70 of the segment 52 allows the segment 52 to slide down into a contact with the lower side washer 82 in spite of the fact that the gusset 46 is in direct contact with the impact wall section 26 at its lower end. In a similar manner as with the gussets 46, each of the gussets 44 is provided with a peripheral notch 88, matching with the outer support bar 66, and making it possible for the segment 52, thanks also to the intermediate notches 68, to slide down into contact with the support surfaces 90 of the gussets 44 in spite of the fact that the gussets 44 are in direct contact with the impact wall section 26 at their respective lower ends. In this manner the outer support bar 66 may both provide strength to the segment 52 and also lock it at the impact wall section 26 of the crusher, thereby reducing the risk that the segment 52 is released and comes into contact with the rotor, and/or comes into the path of the accelerated first flow of material.

Figure 8:
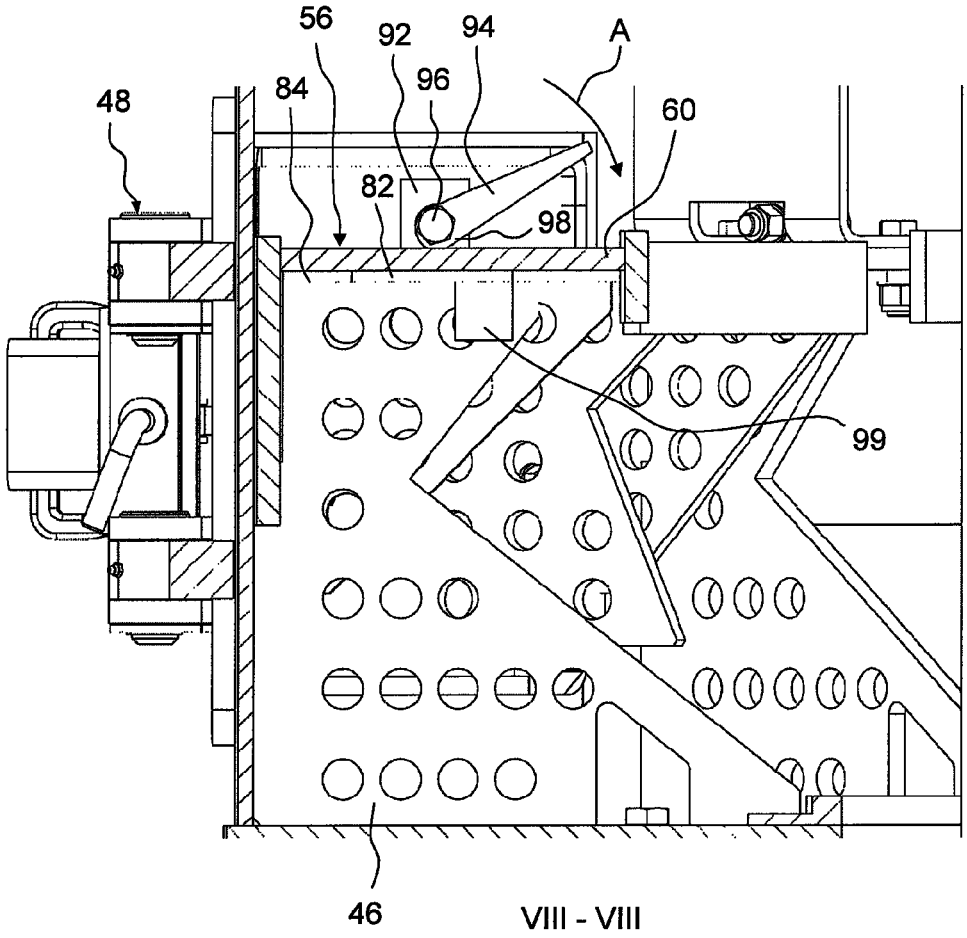
FIG. 8 is an enlarged cross-sectional view, and illustrates an alternative exemplary device holding cavity ring segments in place, as seen in the direction of the arrows VIII-VIII of FIG. 3.

FIG. 8 illustrates the manner in which the segments 50 and 56, both of which are illustrated in FIG. 3, are fixed adjacent to the door 48. Since it is necessary that the door 48, and its attached segment 58, can be swung open, at maintenance stops and inspections, it is sometimes less preferred to fix the segments 50 and 56 with wedges adjacent to the door 48. The principle of fixing segment 50 is similar to that of fixing segment 56, the latter being illustrated in FIG. 8. Hence, and as is illustrated in FIG. 8, a second type of gusset 46 located at a side of the inspection door 48 may be provided with an extension 92 extending from the underside of the segment 56 to the upper side of the segment 56. A locking device in the form of a handle 94 has been mounted on the extension 92 by a bolt 96. At the lower end of the handle 94 a cam 98 is provided. When turning the handle 94 in the direction of the arrow A the cam 98 will get into contact with the upper surface of the support plate 60 and will press the segment 56 downwards toward the lower side washer 82 resting on the support surface 84 of the gusset 46. As mentioned hereinbefore with reference to FIG. 7, and as is also illustrated in FIG. 8, the lower side washer 82 is provided with extensions, of which one extension 99 is shown in FIG. 8, such that the lower side washer 82 "rides" on the gusset 46. When the handle 94 has reached its end position, the end position being a contact between the handle 94 and the upper surface of the support plate 60, the cam 98 retains the handle 94 in this locked position, and keeps the segment 56 in a fixed position, pressed against the lower side washer 82 and the gusset 46.

The method of dismounting the segments 50, 52, 54, 56 and 58 of the cavity ring 28 will now be described with reference to FIGS. 1-8.

In a first step, the inspection door 48, illustrated in FIG. 3, is opened to allow access to the interior of the crusher 1. In an alternative embodiment, the entire upper portion of the crusher, including, for example, the portion of the crusher including the inner and outer hoppers 8, 10 illustrated in FIG. 1, may be removed for even better access to the lower portion 42.

In a second step, the hillsides 38, illustrated in FIG. 1, are removed from the cavity ring 28. After that the three wedges 80, that are best shown in FIGS. 3 and 6, are removed from their respective wedge opening 76. Such removal can be effected by hammering in a horizontal direction on the narrow end of the respective wedge 80. After removing the wedges 80, the upper side washers 78 may be removed. Then, the two handles 94, that are best shown in FIGS. 3 and 8, are turned to make the respective cam 98 release the pressure applied on the respective support plate 60.

In a third step each of the segments 50, 52, 54, 56 is lifted vertically upwards to come free of the peripheral notches 86, 88 of the respective gussets 46, 44. The segments may now be removed from the lower portion 42 via the door 48, or via the upper side of the lower portion 42, in case the outer hoppers 8, 10 have been removed from the lower portion 42. The lower side washers 82, illustrated in FIGS. 7 and 8, would normally remain in place during the maintenance stop. If the fifth segment 58 would need replacement the bolts holding it fixed to the door 48 are unscrewed.

When new, or repaired, segments 50, 52, 54, 56 are to be reinstalled into the lower portion 42, the following steps are conducted:

In a first step the segments 50, 52, 54, 56 are inserted into the lower portion via the door 48, or via the upper side of the lower portion 42, in case the hoppers 8, 10 have been removed. Each segment is then slid vertically downwards to have the respective outer support bar 66 fit in the peripheral notches 86, 88 of the gussets 46, 44, and to make the notches 68, 70 of the support bar 66 embrace the gussets 44, 46 in the manner illustrated in, for example, FIGS. 5 and 7.

In a second step the upper side washers 78 are located around the extensions 74 of the respective gussets 46. The narrow end of each wedge 80 is then inserted in a respective wedge opening 76, which is best illustrated in FIGS. 6 and 7. By hammering in a horizontal direction on the thick end of the respective wedge 80, the wedge 80 is made to apply a downwardly directed fixing force on the respective support plate 60, pressing the support plate 60 against the support surface 84, via the lower side washer 82, of the respective gusset 46. Such hammering not only applies a suitable force, but also locks the wedge 80 in its position in the wedge opening 76. Then, the two handles 94, that are best shown in FIGS. 3 and 8, are turned to make the respective cam 98 apply pressure on the respective support plate 60, and to lock the handle 94 in this position. If the fifth segment 58 would need replacement, a new fifth segment 58 is bolted to the door 48.

In a third step the door 48 is closed, and/or the hoppers 8, 10 are returned to their position of FIG. 1, as the case may be, and the crusher 1 is ready for operation.

It will be appreciated that numerous modifications of the embodiments described above are possible within the scope of the appended claims.

Above it has been described that the extensions 74 are located between the ring segments, for example between the ring segments 50 and 52 as is illustrated in FIG. 6. It will be appreciated that it would also be possible, as alternative, to provide an extension notch in the form of an opening in the central portion of the horizontal plate, and have an extension of the gusset extending through such an opening.

Hereinbefore it has been described, with reference to FIG. 3, for example, that the cavity ring 28 is kept in place by a combination of wedges 80, handles 94, and one segment 58 being bolted to the inspection door 48. It will be appreciated that other combinations are also possible. For example, all of the segments could be kept in place by wedges, with none of the segments being bolted to the door.

Hereinbefore, it has been described, with reference to FIG. 5, that each segment 52 is supported by three gussets of the first type of gussets 44, and two gussets of the second type of gussets 46, the latter being located at the end of the segment and being shared with adjacent segments. It will be appreciated that the supports could be arranged in alternative manners, for example with anything from 1 to 6 gussets of the first type of gussets supporting each segment, and 1 to 3 gussets of the second type of gussets supporting each segment. It would also be possible to support the segments with only gussets of the second type of gussets, or with only gussets of the first type of gussets.

The invention claimed is:

1. A vertical shaft impact crusher for crushing material comprising:

a rotor for accelerating a first flow of material to be crushed, a first feed element for feeding the first flow of material to the rotor, a housing comprising a circumferential impact wall section against which the accelerated first flow of material may be crushed, a second feed element for feeding a second flow of material to be crushed towards a distributing wall section of said housing and further into the path of the accelerated first flow of material, a cavity ring separating said impact wall section from said distributing wall section, wherein said cavity ring comprises at least two separate ring segments, at least one of the ring segments being a wear part adapted for forming a part of said cavity ring, and wherein at least two supports are provided for supporting said at least two ring segments and a locking device is provided for pressing at least the wear part towards at least one of said supports.

2. The crusher according to claim 1, wherein at least one of said supports is located below said at least two ring segments and said locking device is located, at least partly, above said at least two ring segments.

3. The crusher according to claim 1, wherein at least one of said supports comprises an extension being adapted for extending from a lower side of at least one of said at least two ring segments to an upper side of said ring segment.

4. The crusher according to claim 3, wherein said locking device comprises at least one wedge being adapted for cooperating with said extension for pressing at least one of said ring segments towards at least one of said supports.

5. The crusher according to claim 3, wherein at least one of said at least two ring segments comprises at least one extension notch adapted to embrace, at least partly, said extension.

6. The crusher according to claim 5, wherein at least one of said extension notches is located at an end of the ring segment.

7. The crusher according to claim 1, wherein at least one of said ring segments comprises a horizontal plate and an outer support bar attached to the horizontal plate and the at least one of said ring segments is adapted for cooperating with at least one of said supports for locking the ring segment in the horizontal direction.

8. The crusher according to claim 1, wherein said cavity ring comprises at least four ring segments.

9. The crusher according to claim 1, wherein said cavity ring comprises four to six ring segments.

10. The crusher according to claim 1, wherein said locking device comprises a handle and a cam being rotatably mounted to an extension being adapted for extending from a lower side of at least one of said at least two ring segments to an upper side of said ring segment, and wherein the cam is adapted for pressing against the upper side of at least one of said ring segments upon a turning of the handle.

11. A vertical shaft impact crusher wear part for a vertical shaft impact crusher, said crusher comprising a rotor for accelerating a first flow of material to be crushed, a first feed element for feeding the first flow of material to the rotor, a housing comprising a circumferential impact wall section against which the accelerated first flow of material may be crushed, a second feed element for feeding a second flow of material to be crushed towards a distributing wall section of said housing and further into the path of the accelerated first flow of material, and a cavity ring that, when mounted, separates said impact wall section from said distributing wall section, wherein the wear part comprises:

a ring segment being adapted for forming a part of said cavity ring comprising at least two separate ring segments, said ring segment being adapted for being supported by at least one support, and being adapted for being pressed towards said at least one support by a locking device.

12. A cavity ring for a vertical shaft impact crusher for crushing material, said crusher comprising a rotor for accelerating a first flow of material to be crushed, a first feed element for feeding the first flow of material to the rotor, a housing comprising a circumferential impact wall section against which the accelerated first flow of material may be crushed, and a second feed element for feeding a second flow of material to be crushed towards a distributing wall section of said housing and further into the path of the accelerated first flow of material, wherein the cavity ring comprises:

at least two separate ring segments that are adapted for being supported by at least two supports and adapted to separate said impact wall section from said distributing wall section, when mounted, and wherein at least one of said ring segments is adapted for being pressed towards at least one of said supports by a locking device.

* * * * *